US010618603B2

(12) United States Patent
Mills et al.

(10) Patent No.: US 10,618,603 B2
(45) Date of Patent: Apr. 14, 2020

(54) SYSTEMS AND METHODS OF REDUCING FOULING IN SEAWATER SYSTEMS

(71) Applicants: Eric Christopher Mills, Annapolis, MD (US); Ryan Patrick Mills, Houston, TX (US)

(72) Inventors: Eric Christopher Mills, Annapolis, MD (US); Ryan Patrick Mills, Houston, TX (US)

(73) Assignee: Eric Christopher MILLS et al, Annapolis, MD (US)

( * ) Notice: Subject to any disclaimer, the term of this patent is extended or adjusted under 35 U.S.C. 154(b) by 0 days.

(21) Appl. No.: 16/139,615

(22) Filed: Sep. 24, 2018

(65) Prior Publication Data

US 2019/0248448 A1 Aug. 15, 2019

Related U.S. Application Data

(63) Continuation-in-part of application No. 15/892,539, filed on Feb. 9, 2018, now Pat. No. 10,137,966.

(51) Int. Cl.

| | |
|---|---|
| ***B63B 13/02*** | (2006.01) |
| ***B63J 2/12*** | (2006.01) |
| *B63J 2/00* | (2006.01) |
| *B63B 57/00* | (2006.01) |

(52) U.S. Cl.

CPC ..... *B63B 13/02* (2013.01); *B63J 2/12* (2013.01); *B63B 2057/005* (2013.01); *B63J 2002/005* (2013.01)

(58) Field of Classification Search

CPC ..... B63B 13/00; B63B 39/00; B63B 39/03; B63B 57/00; B63B 13/02; G05D 7/06; G05D 7/0652; B63J 2/00; B63J 2/12

USPC ..... 114/125

See application file for complete search history.

(56) References Cited

U.S. PATENT DOCUMENTS

| | | | | |
|---|---|---|---|---|
| 4,314,519 | A * | 2/1982 | Yunoki | B63B 39/03 114/125 |
| 5,692,451 | A | 12/1997 | Pastore | |
| 6,053,121 | A | 4/2000 | Tamashima | |
| 6,766,754 | B1 | 7/2004 | Scott | |
| 6,904,858 | B2 | 6/2005 | Pastore | |
| 8,215,254 | B2 * | 7/2012 | Pavlow | B63B 13/02 114/125 |
| 10,137,966 | B1 * | 11/2018 | Mills | B63B 13/00 |

* cited by examiner

*Primary Examiner* — Lars A Olson

(74) *Attorney, Agent, or Firm* — Duane Morris LLP

(57) ABSTRACT

Systems and methods are presented of operating a seawater system to reduce fouling. The seawater system may be installed in a waterborne vessel. A method comprises establishing suction in a first manifold, drawing seawater through a first manifold port, and discharging seawater through a second manifold simultaneous to drawing fluid through the first manifold port. The first manifold is in fluid communication with a first manifold port defined by a cover assembly. The second manifold is in fluid communication with a second manifold port defined by the cover assembly. The cover assembly is positioned in contact with a body of seawater.

16 Claims, 7 Drawing Sheets

SYSTEMS AND METHODS OF REDUCING FOULING IN SEAWATER SYSTEMS

CROSS-REFERENCE TO RELATED APPLICATIONS

The present application is a continuation-in-part of U.S. patent application Ser. No. 15/892,539 filed Feb. 9, 2018, now U.S. Pat. No. 10,137,966, the entirety of which is hereby incorporated by reference.

BACKGROUND

Seawater systems are commonly used to cool industrial activities that produce heat, such as heat-producing machinery. For example, seawater systems are frequently used to cool engine and engineering equipment on a ship, and seawater systems are also used to cool machinery in power plants and factories located at or near a coastline.

A typical seawater system comprises a seawater intake, a pump, a heat exchanger, and a discharge. The pump is used to draw suction at the seawater intake, and seawater is directed into a heat exchanger where it typically receives heat from another cooling fluid (such as oil, water, or refrigerant) before being discharged back into the sea. Seawater intakes may also be utilized in other applications. For example, where seawater is used as a firefighting agent a seawater intake may draw seawater into a firefighting system or firefighting support system such as a fire main.

One problem known to commonly plague seawater systems is the tendency of the seawater intake to become fouled by the flora and fauna of the sea. When suction is established at a seawater intake, various fish, jellyfish, sea grasses, and other impediments may be drawn into the intake. This fouling of the intake may severely limit seawater flow into the seawater system which, in turn, can lead to potentially catastrophic impacts to systems and machines that rely on seawater for cooling. There is thus a need for improvements in the art of seawater systems to reduce fouling of seawater intakes.

SUMMARY

According to some aspects of the present disclosure, a method is presented of operating a seawater system of a waterborne vessel to reduce fouling. The method comprises establishing suction in a first manifold having a first manifold port, drawing seawater through the first manifold port, and discharging seawater through a second manifold port. The first manifold is in fluid communication with a first manifold port defined by a cover assembly. The cover assembly is positioned in contact with a body of seawater. The second manifold port is defined by the cover assembly. A second manifold is in fluid communication with the second manifold port. The discharging of seawater through the second manifold port is simultaneous to drawing fluid through the first manifold port.

In some embodiments the method further comprises securing discharge of seawater through the second manifold port while continuing to draw fluid through the first manifold port. In some embodiments the method further comprises establishing suction in the second manifold after the step of securing discharge of seawater through the second manifold port, and drawing seawater through the second manifold port.

In some embodiments the method further comprises securing suction in the first manifold after the step of drawing seawater through the second manifold port. In some embodiments the method further comprises discharging seawater through the first manifold port simultaneous to drawing fluid through the second manifold port.

In some embodiments the method further comprises monitoring at least one of the following operating parameters to evaluate the seawater system for fouling of one or more of the first manifold port and the second manifold port: lowering suction pressure, rising seawater temperature, lowering vacuum in a heat exchanger, and any indication of pump cavitation. In some embodiments the method further comprises changing suction from the first manifold to the second manifold and changing discharge from the second manifold port to the first manifold port responsive to the monitoring of at least one operating parameter.

According to another aspect of the present disclosure, a system is disclosed of reducing fouling of a seawater intake of a waterborne vessel. The system comprises a cover assembly, a first port, a second port, and a pump. The cover assembly is positioned in contact with a body of seawater. The first port is defined by the cover assembly, coupled to a first manifold, and positioned to direct seawater from the body into the first manifold. The second port is defined by the cover assembly, coupled to a second manifold, and positioned to direct seawater from the body into the second manifold. The pump is in fluid communication with the first manifold and the second manifold. The pump is configurable to draw suction in one of the first manifold or the second manifold and discharge to the other of the first manifold or the second manifold.

In some embodiments the pump is configurable to draw suction in one of the first manifold or the second manifold simultaneous to discharging to the other of the first manifold or the second manifold. In some embodiments the body of seawater is a void within a hull of the waterborne vessel. In some embodiments the pump is configurable by manipulation of one or more valves.

In some embodiments the first port and the second port are spaced from each other at a distance less than or equal to a diameter of the first port or the second port. In some embodiments the first port and the second port are spaced from each other in a vertical direction. In some embodiments the first port and the second port are spaced from each other in a horizontal direction.

In some embodiments one or both of the first port and the second port comprises a plurality of ports, with each port coupled to the respective one of the first manifold and the second manifold. In some embodiments one or more ports coupled to the first manifold are spaced from one or more ports coupled to the second manifold in a vertical or horizontal direction. In some embodiments the system further comprises a source of fluid pressurized independent of the pump, the source selectively in fluid communication with one or both of the first manifold and the second manifold.

In some embodiments one or both of the first manifold and the second manifold comprise: a first member coupled between a respective port and a suction intake of the pump; and a second member coupled between a discharge outlet of the pump and the first member. In some embodiments the second member is coupled to the first member at a joint. In some embodiments one or both of the first manifold and the second manifold further comprise: a suction isolation valve positioned in the first member between the joint and the pump; and a discharge isolation valve positioned in the second member between the pump and the joint.

According to yet further aspects of the present disclosure, a method is disclosed of operating a seawater system to reduce fouling. The method comprises establishing suction in a first manifold, drawing seawater through a first manifold port, and discharging seawater through a second manifold port. The first manifold is in fluid communication with a first manifold port positioned in contact with a body of seawater. The second manifold port is positioned in contact with the body of seawater and has a second manifold in fluid communication with the second manifold port. The first manifold port and the second manifold port are spaced from each other at a distance less than or equal to twice the diameter of one of the first manifold port and the second manifold port. The discharging of seawater through the second manifold port is simultaneous to drawing fluid through the first manifold port.

BRIEF DESCRIPTION OF THE DRAWINGS

The following will be apparent from elements of the figures, which are provided for illustrative purposes.

Figure 1:
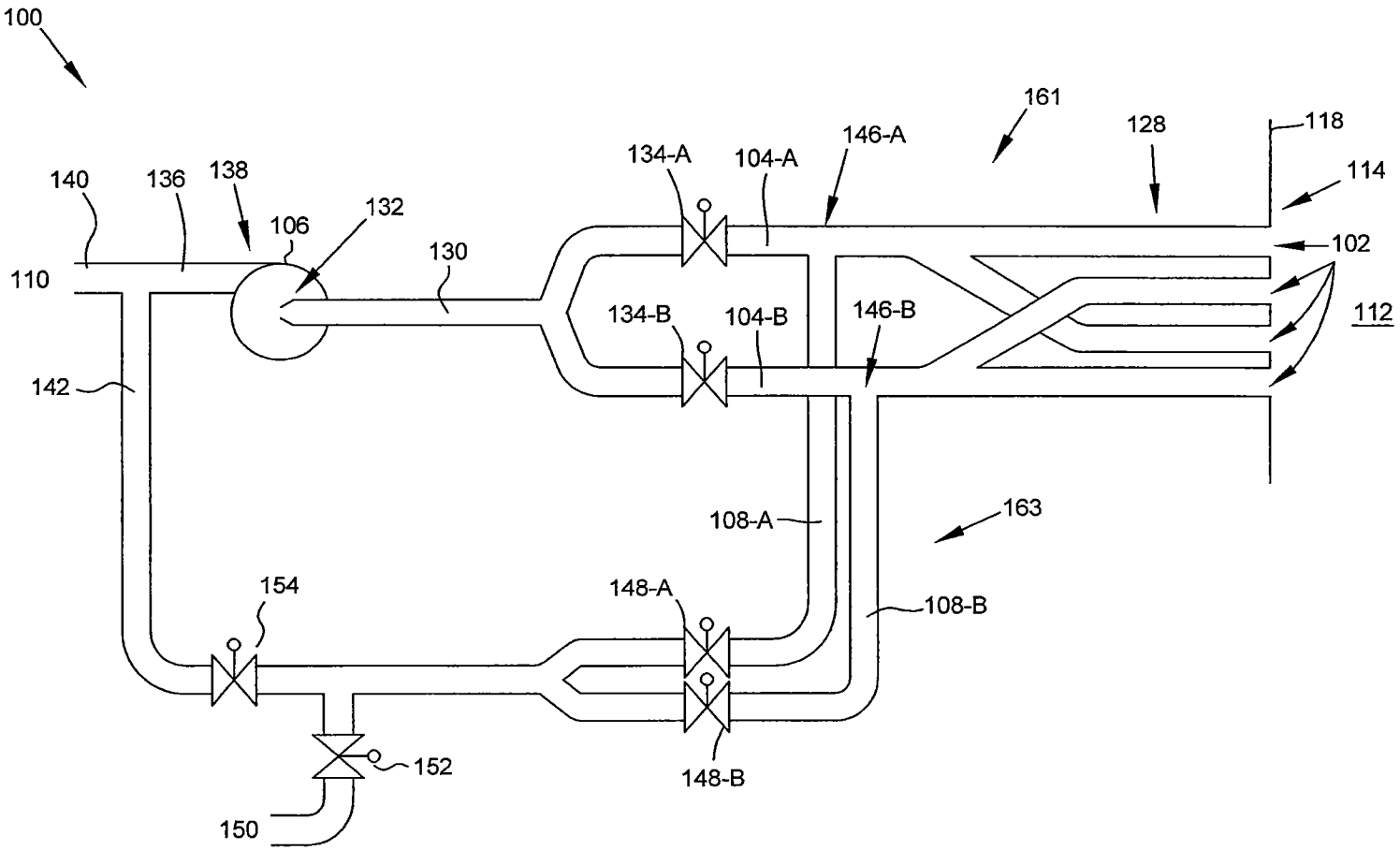
FIG. 1 is a simplified schematic diagram of a seawater system in accordance with some embodiments of the present disclosure.

The present application discloses illustrative (i.e., example) embodiments. The claimed inventions are not limited to the illustrative embodiments. Therefore, many implementations of the claims will be different than the illustrative embodiments. Various modifications can be made to the claimed inventions without departing from the spirit and scope of the disclose. The claims are intended to cover implementations with such modifications.

DETAILED DESCRIPTION

For the purposes of promoting an understanding of the principles of the disclosure, reference will now be made to a number of illustrative embodiments in the drawings and specific language will be used to describe the same.

The present disclosure is directed to systems and methods of addressing the aforementioned shortcomings in the art of seawater systems, namely the reduction of fouling of seawater intakes. The present disclosure provides systems and methods of reducing fouling that includes the simultaneous drawing of suction at a first seawater port and discharging of seawater through a second seawater port. The first and second seawater ports are positioned in a common location on a ship's hull. For example, the first and second seawater ports may be defined by a common cover assembly, or disposed in a common sea chest, or closely spaced from each other. The discharge of recirculated seawater in the vicinity of drawing suction reduces the likelihood that fouling will occur at that location of the ship's hull.

FIG. 1 is a simplified schematic diagram of a seawater system 100 in accordance with some embodiments of the present disclosure. The system 100 comprises two or more seawater ports 102, a pair of intake and discharge manifolds 104-A, 104-B, a seawater pump 106, and a pair of recirculation lines 108-A, 108-B. In operation, the seawater pump 106 may draw suction through one of the manifolds 104-A, 104-B and discharge seawater to a seawater load 110. Seawater may be simultaneously recirculated via one of the recirculation lines 108-A, 108-B and discharged via the manifold 104-A, 104-B that is not drawing suction.

At least two seawater ports 102 are included in the system 100. The seawater ports 102 may be defined by a hull of a ship or similar waterborne vessel, a sea chest, or a cover assembly. The seawater ports provide and are in fluid communication between a body of seawater 112 and a respective manifold 104-A, 104B.

Figure 2B:
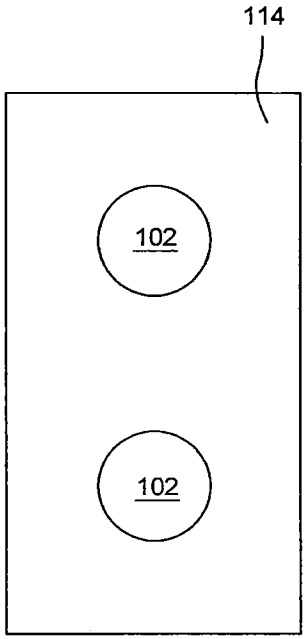
FIG. 2B is a simplified profile view of a cover assembly defining one or more seawater ports in accordance with some embodiments of the present disclosure.
Figure 2A:
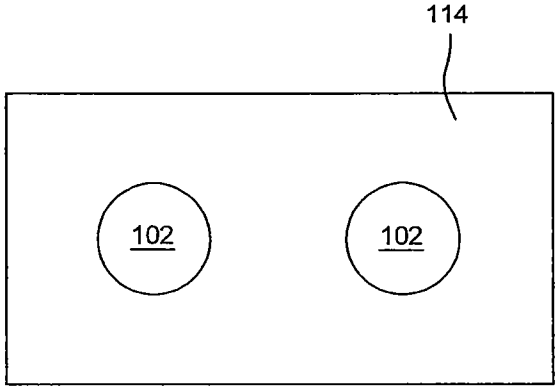
FIG. 2A is a simplified profile view of a cover assembly defining one or more seawater ports in accordance with some embodiments of the present disclosure.

Seawater ports 102 may be defined by a cover assembly 114 such as that shown in FIG. 2A, 2B, 3, or 4. Each of those figures provide a profile view of a cover assembly 114 in accordance with various embodiments of the present disclosure. FIGS. 2A and 2B illustrate just two seawater ports 102, which, as stated above, are the minimum number of seawater ports 102 for system 100. The seawater ports 102 may be spaced from each other horizontally or in a horizontal direction (as shown in FIG. 2A). The seawater ports 102 may be spaced from each other vertically or in a vertical direction (as shown in FIG. 2B). As used herein, "horizontally" indicates a direction substantially parallel with the length of the ship (i.e. along the ship's keel) and "vertically" indicates a direction substantially parallel to the height of the ship.

The seawater ports 102 may be closely spaced from each other. For example, in some embodiments the seawater ports 102 may be spaced from each other at a distance less than or equal to a diameter of one of the seawater ports 102. The seawater ports 102 may be spaced from each other at a distance less than or equal to twice a diameter of one of the seawater ports 102. For non-circular seawater ports, the seawater ports 102 may be spaced from each other at a distance less than or equal to a horizontal dimension or a vertical dimension of one of the seawater ports 102. Spacing of the seawater ports 102 from each other is a feature of the present disclosure that can affect the potential fouling of a seawater port 102 that is drawing suction because the discharge from an adjacent seawater ports 102 disrupts the potential fouling. Thus, excessive distance between seawater ports 102 may greatly reduce the effectiveness of the systems and methods disclosed herein.

The cover assembly 114 may be mounted to the ship's hull or disposed within a sea chest. Alternatively, the cover assembly 114 may be a portion of the ship's hull that defines the seawater ports 102.

Figure 3:
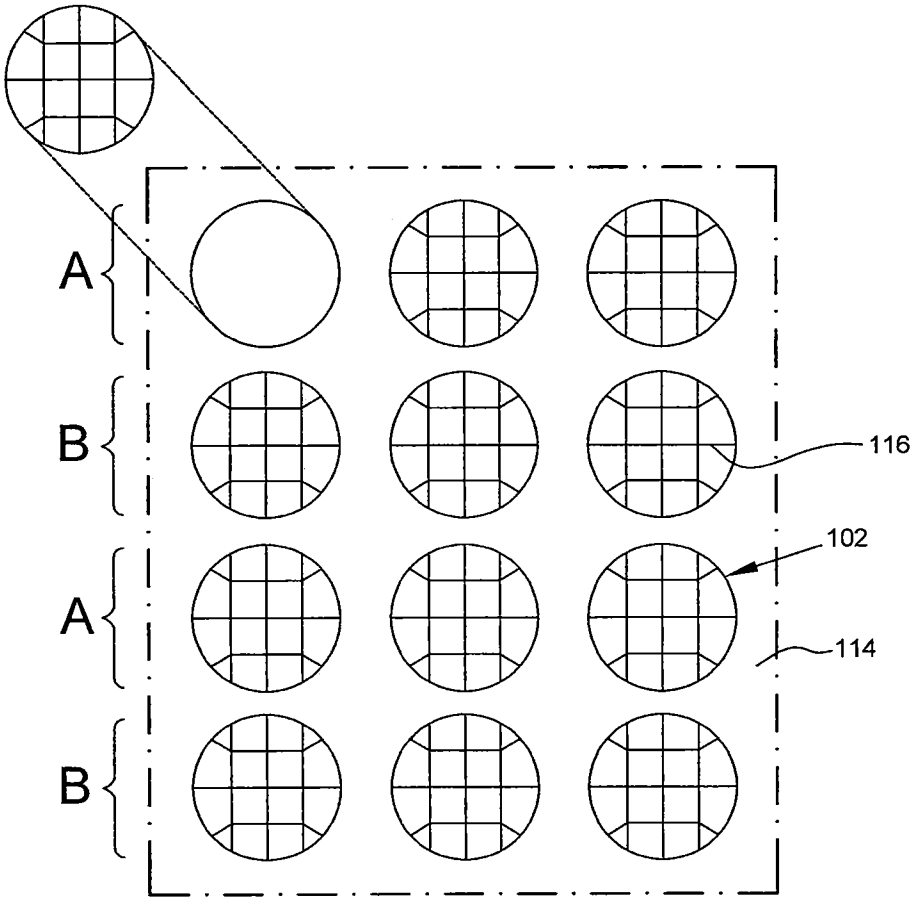
FIG. 3 is a simplified profile view of a cover assembly defining one or more seawater ports in accordance with some embodiments of the present disclosure.

At FIG. 3, a cover assembly 114 is disclosed that defines a plurality of seawater ports 102. More specifically, the cover assembly 114 of FIG. 3 discloses twelve seawater ports 102 arranged in four horizontal rows of three seawater ports 102 each (alternatively viewed as three vertical rows of four seawater ports 102 each). As illustrated in FIG. 3, each seawater port 102 may have a grate 116 or similar filtering structure extending across the port 102. The grate 116 may be coupled to the cover assembly 114 or ship's hull. The grate 116 acts as a first line of defense against fouling of the seawater system 100 by blocking large debris from entering through the seawater port 102.

In the embodiment of FIG. 3, the seawater ports 102 may be grouped by horizontal row and commonly coupled to one of the intake and discharge manifolds 104-A, 104-B. Thus the seawater ports 102 of the top horizontal row are designated "A" and coupled to manifold 104-A, while the seawater ports 102 of the bottom horizontal row are designated "B" and coupled to manifold 104-B. When couple to, or in fluid communication with, a manifold 104, the seawater port 102 may be referred to as a manifold port.

Figure 4:
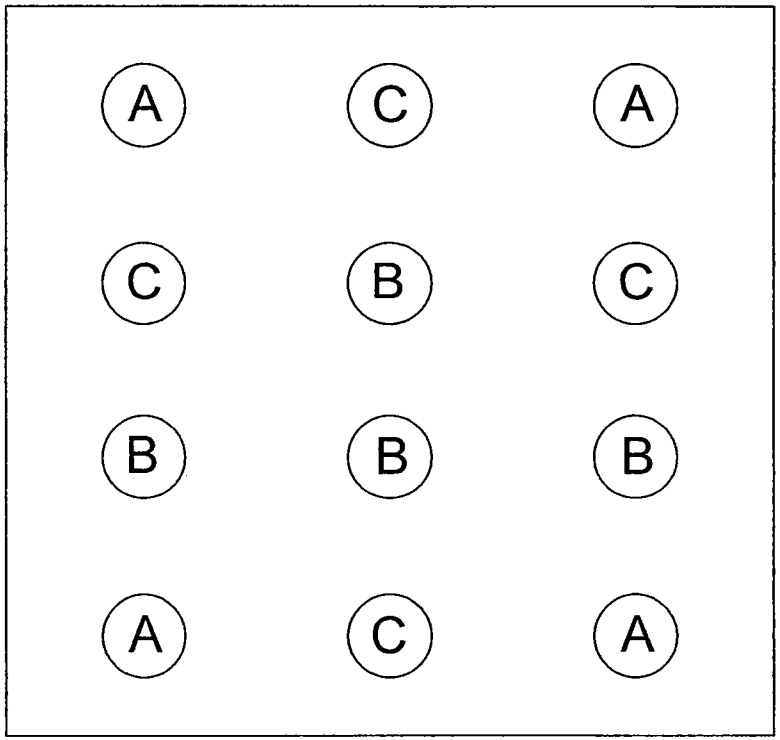
FIG. 4 is a simplified profile view of a cover assembly defining one or more seawater ports in accordance with some embodiments of the present disclosure.

Although FIGS. 2A, 2B, and 3 disclose embodiments having two and twelve seawater ports 102, the present disclosure is not so limited. Indeed, the present disclosure contemplates any number of seawater ports 102 coupled to any number of intake and discharge manifolds 104. Similarly, although the plurality of seawater ports 102 may be divided into rows or "banks" of ports 102 for ease of coupling to manifolds 104, the present disclosure is not so limited. As shown in FIG. 4, a plurality of seawater ports 102 may be divided in any manner and coupled to any number of manifolds 104. In the illustrated embodiment of FIG. 4, the twelve seawater ports 102 defined by cover assembly 114 are coupled to three manifolds designated A, B, and C. The arrangement of seawater ports 102 in the cover assembly 114 assigned to each manifold is not required to follow any specific pattern or convention.

Figure 5B:
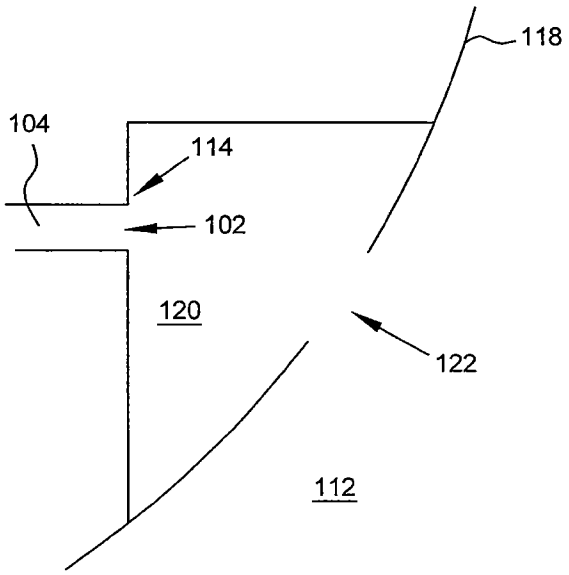
FIG. 5B is a simplified cross-sectional schematic view of a portion of a ship's hull having a sea chest with a seawater port therethrough in accordance with some embodiments of the present disclosure.
Figure 5A:
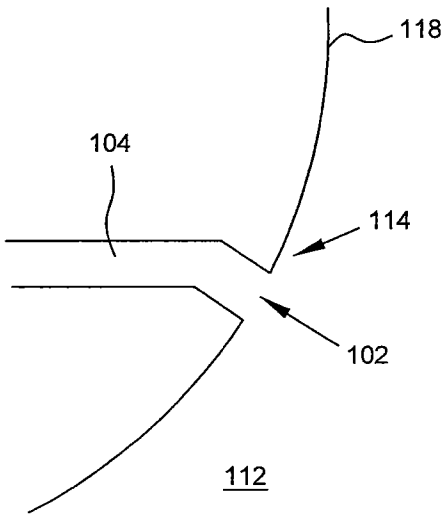
FIG. 5A is a simplified cross-sectional schematic view of a portion of a ship's hull having a seawater port therethrough in accordance with some embodiments of the present disclosure.

The cover assembly 114 defining the seawater ports 102 may be positioned in contact with a body of seawater 112. The cover assembly 114 may be positioned in direct contact with open sea, such as when the cover assembly 114 is mounted directly to an outer hull 118 of the ship as shown in FIG. 5A. However, the cover assembly 114 may also be positioned to indirectly contact the sea, such as when the cover assembly 114 is mounted in a sea chest 120 or similar internal void within the outer hull 118 of a ship. The sea chest 120 may be in fluid communication with a body of seawater 112 via an opening 122 in the outer hull 118.

Figure 6:
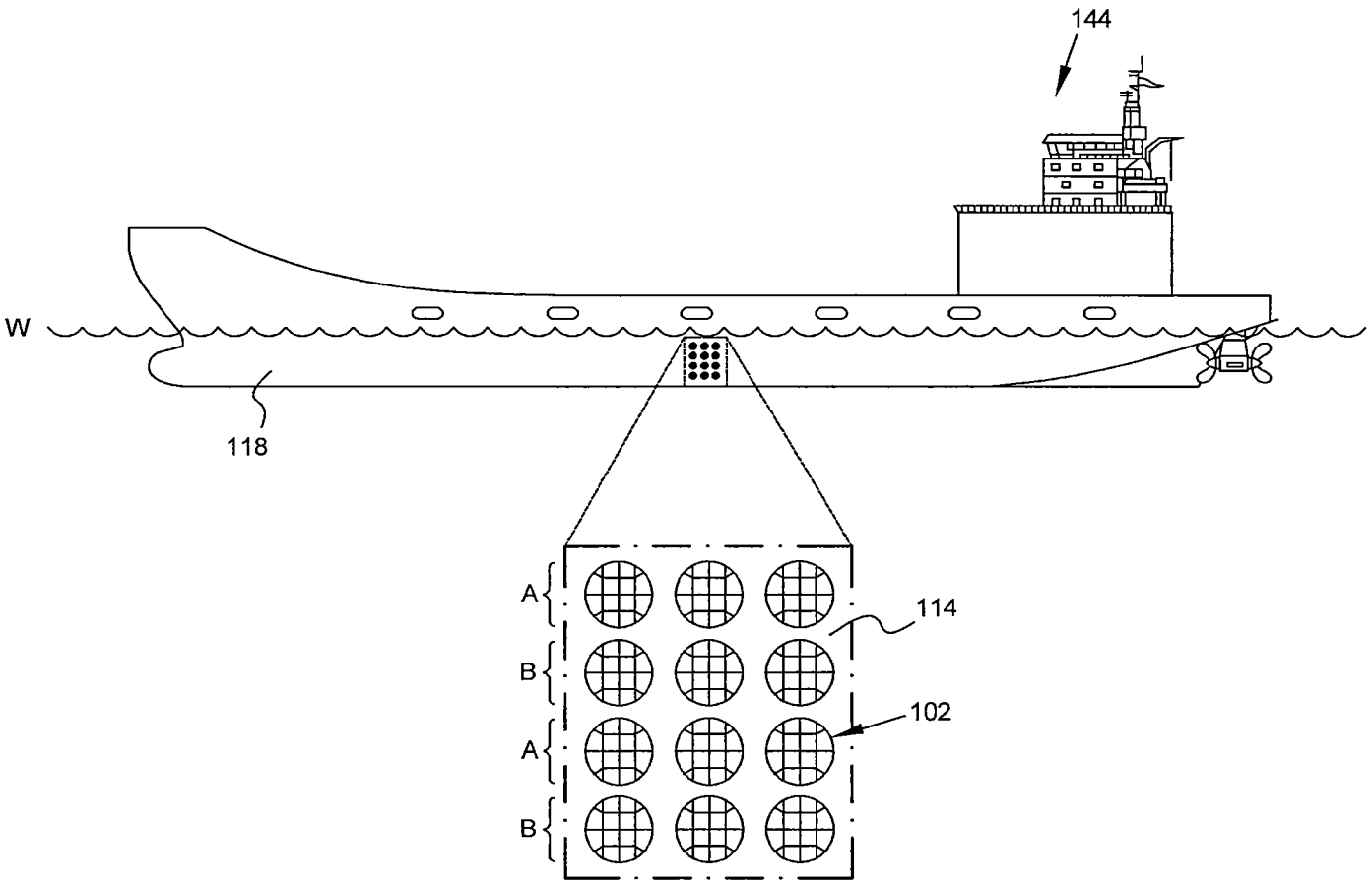
FIG. 6 is a simplified side profile view of a ship having a cover assembly defining one or more seawater ports in accordance with some embodiments of the present disclosure.

FIG. 6 provides an example of the positioning of a cover assembly 114 on or along the hull 118 of a waterborne vessel 144. The cover assembly 114 and seawater ports 102 are positioned below the waterline W. The cover assembly 114 and seawater ports 102 may be located in the hull 118 proximate the seawater loads 110 served by the seawater system 100.

Returning to FIG. 1, the seawater ports 102 provide fluid communication between a body of seawater 112 and a manifold 104. In the illustrated embodiment, a pair of seawater ports 102 are coupled to a first intake and discharge manifold 104-A, and a pair of seawater ports 102 are coupled to a second intake and discharge manifold 104-B. In embodiments having more than one seawater ports 102 coupled to each manifold 104, an appropriate number of pipes 128 may be used to couple the seawater ports 102 to the common manifold 104.

The first manifold 104-A and second manifold 104-B join to form a suction header 130 coupled to the suction intake 132 of pump 106. A first suction isolation valve 134-A may be disposed in the first manifold 104-A and a second suction isolation valve 134-B may be disposed in the second manifold 104-B. Any valve may be used as a suction isolation valve 134, although in the disclosed embodiments the suction isolation valves 134 are solenoid operated gate valves. The pump 106 is in fluid communication with the first manifold 104-A and second manifold 104-B.

The pump 106 discharges to a discharge header 136 via a discharge outlet 138 of the pump 106. The discharge header 136 supplies seawater to a load supply header 140 and a recirculation header 142. The load supply header 138 supplies seawater to a seawater load 110, such as a heat exchanger.

The recirculation header 142 splits into a first recirculation line 108-A and a second recirculation line 108-B. Each of the recirculation lines 108-A, 108-B join to a respective manifold 104-A, 104-B at a respective joint 146-A, 146-B. A first discharge isolation valve 148-A may be disposed in the first recirculation line 108-A, and a second discharge isolation valve 148-B may be disposed in the second recirculation line 108-B. The first suction isolation valve 134-A may be positioned between the joint 146-A and the pump 106. The second suction isolation valve 134-B may be positioned between the joint 146-B and the pump 106.

The pump 106 may be a variable speed pump and may be capable of variable rates of discharge. The speed of the pump 106 may be controlled by a controller and/or may be programmable. The pump 106 may be configurable to draw suction in one of the manifolds 104-A, 104-B and discharge to the other of the manifolds 104-A, 104-B. The pump 106 may be configured by the manipulation of one or more valves. For example, the pump 106 may be configurable to draw suction in the first manifold 104-A by opening the first suction isolation valve 134-A and shutting the second suction isolation valve 134-B. The pump 106 may be configurable to simultaneously discharge via the second manifold 104-B by opening the second discharge isolation valve 148-B and shutting the first discharge isolation valve 148-A.

In some embodiments, a suction isolation valve 134-A, 134-B may be coupled to a respective discharge isolation valve 148-A, 148-B via an interlock. The interlock may be implemented through electric, electronic, pneumatic, or similar means. For example, an interlock may couple first suction isolation valve 134-A to first discharge isolation valve 148-A such that only one of those valves may be open at a given time. A command to open one of the valves may result in automatically shutting of the other valve. An interlock may also couple the second suction isolation valve 134-B to the second discharge isolation valve 148-B.

In some embodiments, the system 100 may comprise more than one pump 106. For example, the system 100 may include a booster pump (not shown) in fluid communication with the pump 106. The system 100 may include a pair of pumps 106 operated in parallel.

For each of the first manifold 104-A and second manifold 104-B, the portion of piping between a respective seawater port 102 and the suction intake 132 of the pump 106 may be referred to as a first member 161 or first leg. The portion of piping between the discharge outlet 138 of the pump 106 and the first member 161 may be referred to as a second member 163 or second leg. The second member 163 may be coupled to the first member 161 of a respective manifold 104-A, 104-B at a joint 146-A, 146-B. A respective suction isolation valve 134-A, 134-B may be positioned in the first member 161 between the joint 146-A, 146-B and the pump 106. A respective discharge isolation valve 148-A, 148-B may be positioned in the second member 163 between the pump 106 and joint 146-A, 146-B.

In some embodiments the seawater system 100 further comprises a source 150 of pressurized fluid coupled to the system at either the recirculation header 142 or one or more of the recirculation lines 108-A, 108-B. The pressurized fluid may be, for example, fresh water or seawater. The source 150 of the pressurized fluid may be a source independent of pump 106, such that the pump 106 is not pressurizing the fluid or providing a motive force to the fluid. In other words, the fluid from source 150 may be pressurized independent of pump 106. The source 150 may be a fire main system.

The source 150 may be used to discharge fluid via one or both of the manifolds 104-A, 104-B without recirculating seawater from the pump 106. A recirculation header isolation valve 154 may be provided in the recirculation header 142, and a source isolation valve 152 may be provided between the source 150 and the recirculation header 142. With the recirculation header isolation valve 154 shut and the source isolation valve 152 open, flow of the pressurized fluid may be induced from the source 150 to one or both of the manifolds 104-A, 104-B. The source 150 thus provides a means of discharge independent of pump 106.

In operation, the pump 106 is operated to draw suction on one of the manifolds 104-A, 104-B. The suction isolation valve 134-A, 134-B of the respective manifold 104-A, 104-B on which suction is drawn is open, while the suction isolation valve 134-A, 134-B of the other manifold 104-A, 104-B is shut. The system 100 may be operated for some time drawing suction in one manifold 104-A, 104-B and supplying seawater to a seawater load 110 without recirculation.

The system 100 may be operated with recirculation. During such operation, the suction isolation valve 134-A, 134-B of the manifold 104-A, 104-B on which suction is not drawn remains shut. The discharge isolation valve 148-A, 148-B associated with that manifold 104-A, 104-B is opened, thus allowing flow of seawater through recirculation header 142 and a respective recirculation line 108-A, 108-B. This flow results in discharge of seawater through the manifold 104-A, 104-B on which suction is not drawn. The system 100 may be operated with simultaneous drawing of suction in one manifold 104-A, 104-B and discharging in the other manifold 104-A, 104-B.

When operating with simultaneous drawing of suction in one manifold 104-A, 104-B and discharging in the other manifold 104-A, 104-B, it may be desirable to swap the manifolds 104-A, 104-B such that the manifold 104-A, 104-B drawing suction begins to discharge and the manifold 104-A, 104-B discharging begins to draw suction. Such as swap may be implemented by first securing the discharge via one of the manifolds 104-A, 104-B and then drawing suction in that manifold 104-A, 104-B such that both manifolds 104-A, 104-B are drawing suction. In the manifold 104-A, 104-B drawing suction at the start of the swap procedure the suction is broken and the manifold 104-A, 104-B is changed to a discharge. The swapping of the manifolds 104-A, 104-B in this manner is accomplished via manipulation of one or more of the suction isolation valves 134-A, 134-B and discharge isolation valves 148-A, 148-B.

In some embodiments, the system 100 may be operated with suction drawn in a first of the manifolds 104-A, 104-B for a time, and then suction may be drawn in the other of the manifolds 104-A, 104-B while discharging is commenced in the first of the manifolds 104-A, 104-B. This operation allows for clearing of fouling in the first of the manifolds 104-A, 104-B while continuing to operate the system 100.

In some embodiments, the manifolds 104-A, 104-B are swapped responsive to the monitoring of various parameters associated with the seawater system 100 or related systems such as the seawater loads 110. In some embodiments, the system 100 may be operated with suction drawn in a first of the manifolds 104-A, 104-B for a time, and then responsive to the monitoring of parameters the suction may be draw in the other of the manifolds 104-A, 104-B while discharging is commenced in the first of the manifolds 104-A, 104-B. For example, a non-exclusive list of parameters that may be monitored to evaluate the sufficiency of seawater flow into the seawater system 100 and supplied to the seawater load 110 includes: lowering suction pressure, rising seawater temperature, lowering vacuum in a heat exchanger, and any indication of pump cavitation.

In some embodiments, the system 100 is operated such that seawater is discharged via one of the manifolds 104-A, 104-B continuously. In some embodiments, the system 100 is operated such that seawater is discharged via one of the manifolds 104-A, 104-B at all or substantially all times that suction is drawn in the other of the manifolds 104-A, 104-B. Substantially all times indicates that discharge may be secured for brief periods, such as to swap suction and discharge between the manifolds 104-A, 104-B. The continuous or near-continuous discharge via one of the manifolds 104-A, 104-B improves the mitigating effects of the disclosed systems and methods and thus reduces fouling of the seawater system 100.

In some embodiments, a control system communicates with one or more of the suction isolation valves 134-A, 134-B, discharge isolation valves 148-A, 148-B, source isolation valve 152, and/or recirculation header isolation valve 154 to effect opening and/or shutting of the valves. The control system may be configured to automatically open and/or shut valves to prevent damage to the system 100. The control system may be programmed to take actions. For example, the control system may be programmed to automatically swap the suction manifold and discharge manifold based on one or more of a time interval, sensed temperatures in the system 100 or seawater load 110, and/or sensed pressures in the system 100 or seawater load 110 such as the suction pressure or discharge pressure of system 100.

Figure 7:
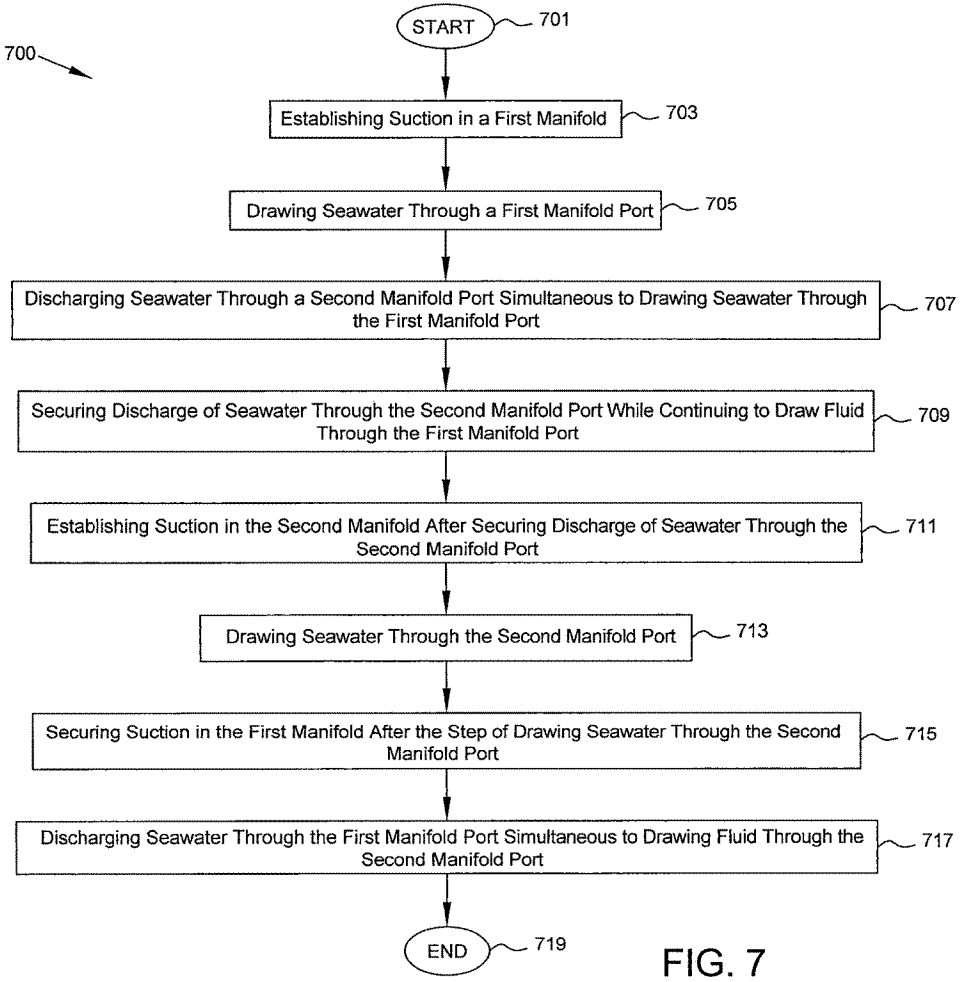
FIG. 7 is a flow diagram of a method in accordance with some embodiments of the present disclosure.

The present disclosure additionally provides methods of reducing fouling of seawater systems. One such method 700 is presented in FIG. 7. The method 700 begins at Block 701.

At Block 703, suction is established in a first of the two manifold 104-A, 104-B. Suction may be established via pump 106. Pump 106 may be configured to draw suction in a first of the two manifolds 104-A, 104-B by manipulating one or more of the suction isolation valves 134-A, 134-B.

At Block 705, responsive to the suction established at Block 703 seawater is drawn into or through a first manifold port 102. The first manifold port 102 may be defined by a cover assembly 114 or a hull 118, and may be located at the hull 118 or in a sea chest 120. The first manifold port 102 is in fluid communication with a body of seawater 112. The first manifold port 102 may be a plurality of ports 102 each in fluid communication with a first of the two manifolds 104-A, 104-B.

At Block 707, simultaneous to the drawing of seawater through the first manifold port 102, seawater is discharged through a second manifold port 102. The second manifold port 102 may be defined by a cover assembly 114 or a hull 118, and may be located at the hull 118 or in a sea chest 120. The second manifold port 102 is in fluid communication with a body of seawater 112. The second manifold port 102 may be a plurality of ports 102 each in fluid communication with a first of the two manifolds 104-A, 104-B.

The step of discharging seawater through a second manifold port 102 may involve configuring the pump 106 for such a discharge. For example, the pump 106 may be configured to discharge to a second manifold port 102 by the manipulation of one or more discharge isolation valves 148-A, 148-B.

In some embodiments, method 700 ends after Block 707. However, in some embodiments the method 700 may continue for one or more of Blocks 709 through 717. Performance of the additional steps of Blocks 709 through 717 may be responsive to the monitoring of various parameters of the seawater system 100 or an associated system of the seawater load 110. Performance of the additional steps of Blocks 709 through 717 may be conducted at a timed interval. Performance of the additional steps of Blocks 709 through 717 may be performed selectively by an operator.

At Block 709, the discharge of seawater through the second manifold port 102 is secured while seawater continues to be drawn through the first manifold port 102. Securing the discharge of seawater through the second manifold port 102 may be performed by the manipulation of one or more discharge isolation valves to secure discharge flow to a respective discharge line 108-A, 108-B.

At Block 711, suction may be established in a second of the two manifolds 104-A, 104-B. The step of Block 711 may be performed after discharge is secured in the second of the two manifolds 104-A, 104-B. Suction may be established in second of the two manifolds 104-A, 104-B by manipulation of one or more suction isolation valves 134-A, 134-B.

At Block 713, seawater may be drawn through the second manifold port 102. Seawater may be drawn simultaneously through both the first manifold port 102 and second manifold port 102.

Suction may be secured in the first of the two manifolds 104-A, 104-B at Block 715. Suction may be secured after performance of the step at Block 713. Suction may be secured via the manipulation of one or more suction isolation valves 134-A, 134-B.

At Block 717, seawater may be discharged through the first manifold port 102. The discharge of seawater through the first manifold port 102 may be simultaneous to the drawings of suction through the second manifold port 102. The discharge of seawater through the first manifold port 102 may be performed via the manipulation of one or more of discharge isolation valves 148-A, 148-B.

The optional performance of the steps at Blocks 709 through 717 results in a swapped alignment of the manifolds 104-A, 104-B such that the manifold 104-A, 104-B initially drawing suction is discharging while the manifold 104-A, 104-B initially discharging is drawing suction. Method 700 may be performed at any time interval, such that the method may selectively be paused or halted prior to complete performance.

Method 700 ends at Block 719.

In some embodiments of a method to reduce fouling of a seawater system, the manifolds 104-A, 104-B may be swapped by first securing suction in one of the manifolds rather than securing discharge. Pump 106 may need to be secured prior to executing this manifold swap. For example, suction may be secured in a first of the manifolds 104-A, 104-B and then discharge may be secured in the other of the manifolds 104-A, 104-B such that a brief moment passes with only residual flow through one or both of the manifolds 104-A, 104-B. Suction may then be established in the other of the manifolds 104-A, 104-B (the manifold that was originally discharging in this scenario), and discharge may then be established in the one of the manifolds 104-A, 104-B (the manifold that was originally drawing suction in this scenario).

In some embodiments the system 100 may be operated with suction drawn in both the first manifold 104-A and second manifold 104-B. The pump 106 may draw suction in both manifolds 104-A, 104-B and discharge to the seawater load 110. Both first suction isolation valve 134-A and second suction isolation valve 134-B may be open, while both first discharge isolation valve 148-A and second discharge isolation valve 148-B may be shut. Such operations allow for maximum seawater cooling to be applied to the seawater load 110. Recirculation and discharge may be applied upon detection of initial fouling of one or both manifolds 104-A, 104-B. Such operation of system 100 may be preferred during high intensity operation of the waterborne vessel 144, such as during full power operations in open ocean where the risk of fouling the seawater system 100 is low compared to coastal steaming.

The presently disclosed systems and methods provide numerous advantages over existing seawater systems. First and foremost, the systems and methods disclosed herein reduce fouling of a seawater system, and particularly the seawater port, by simultaneously drawing suction and discharging from seawater ports in close proximity to each other. The seawater ports may be defined by a common cover assembly or closely spaced from each other. The discharge of seawater from one or more of the seawater ports impedes the ingress of debris which tend to foul the seawater system such as sea flora and fauna.

The systems and methods disclosed herein also prevent and/or reduce the need to fully secure a seawater system, or a seawater intake, once fouled. In existing seawater systems, a fouled seawater intake is required to be secured (i.e. not drawing suction) and is typically "blown down" using steam or compressed air to free the intake of debris. This leads to a period of time wherein the seawater system is offline, operating at reduced capacity, or operating without or with limited redundancy. The systems and methods of the present disclosure allow for a modified blow down of the fouled intake—via seawater discharge rather than steam or compressed air—to clear the intake of fouling while simultaneously drawing suction in the other of the manifolds. This permits the seawater system to continue operation unimpeded, which in turn improves the operational readiness and resiliency of a seawater system.

The presently disclosed systems and methods are further advantageous because the use of recirculation to prevent or reduce fouling of a seawater system is less noisy than the existing use of pressurized air or steam to conduct blowdowns of seawater intakes. A smaller acoustic output may be particularly beneficial in applications where noise is a concern, such as operating in sensitive marine environments and/or operating a submarine.

Although the embodiments are discussed herein with reference to a seawater system of a waterborne vessel, the present disclosure is not so limited. The systems and methods disclosed herein may be equally applied to additional seawater systems, such as those employed at power plants, factories, or similar facilities that utilize seawater systems.

Although examples are illustrated and described herein, embodiments are nevertheless not limited to the details shown, since various modifications and structural changes may be made therein by those of ordinary skill within the scope and range of equivalents of the claims.

What is claimed is:

1. A method of operating a seawater system of a waterborne vessel to reduce fouling comprising:

establishing suction in a first manifold, the first manifold in fluid communication with a first manifold port defined by a cover assembly, the cover assembly positioned in contact with a body of seawater;

drawing seawater through the first manifold port;

discharging seawater through a second manifold port defined by the cover assembly and having a second manifold in fluid communication with the second manifold port, wherein the discharging of seawater through the second manifold port is simultaneous to drawing fluid through the first manifold port;

securing discharge of seawater through the second manifold port while continuing to draw fluid through the first manifold port;

establishing suction in the second manifold after the step of securing discharge of seawater through the second manifold port; and drawing seawater through the second manifold port.

2. The method of claim 1 further comprising:

securing suction in the first manifold after the step of drawing seawater through the second manifold port.

3. The method of claim 2 further comprising:

discharging seawater through the first manifold port simultaneous to drawing fluid through the second manifold port.

4. The method of claim 1 further comprising:

monitoring at least one of the following operating parameters to evaluate the seawater system for fouling of one or more of the first manifold port and the second manifold port: lowering suction pressure, rising seawater temperature, lowering vacuum in a heat exchanger, and any indication of pump cavitation.

5. The method of claim 4 further comprising:

changing suction from the first manifold to the second manifold and changing discharge from the second manifold port to the first manifold port responsive to the monitoring of at least one operating parameter.

6. A system of reducing fouling of a seawater intake of a waterborne vessel comprising:

a cover assembly positioned in contact with a body of seawater;

a first port defined by the cover assembly, the first port coupled to a first manifold and positioned to direct seawater from the body into the first manifold;

a second port defined by the cover assembly, the second port coupled to a second manifold and positioned to direct seawater from the body into the second manifold;

a pump in fluid communication with the first manifold and the second manifold, the pump configurable to draw suction in one of the first manifold or the second manifold and discharge to the other of the first manifold or the second manifold; and a source of fluid pressurized independent of the pump, the source selectively in fluid communication with one or both of the first manifold and the second manifold.

7. The system of claim 6 wherein the pump is configurable to draw suction in one of the first manifold or the second manifold simultaneous to discharging to the other of the first manifold or the second manifold.

8. The system of claim 6 wherein the body of seawater is a void within a hull of the waterborne vessel.

9. The system of claim 6 wherein the pump is configurable by manipulation of one or more valves.

10. The system of claim 6 wherein the first port and the second port are spaced from each other at a distance less than or equal to a diameter of the first port or the second port.

11. The system of claim 10 wherein the first port and the second port are spaced from each other in a vertical direction.

12. The system of claim 10 wherein the first port and the second port are spaced from each other in a horizontal direction.

13. The system of claim 6 wherein one or both of the first port and the second port comprises a plurality of ports, with each port coupled to the respective one of the first manifold and the second manifold.

14. The system of claim 13 wherein one or more ports coupled to the first manifold are spaced from one or more ports coupled to the second manifold in a vertical or horizontal direction.

15. The system of claim 6 wherein one or both of the first manifold and the second manifold comprise:

a first member coupled between a respective port and a suction intake of the pump; and a second member coupled between a discharge outlet of the pump and the first member.

16. The system of claim 15 wherein the second member is coupled to the first member at a joint, and wherein one or both of the first manifold and the second manifold further comprise:

a suction isolation valve positioned in the first member between the joint and the pump; and a discharge isolation valve positioned in the second member between the pump and the joint.

* * * * *